United States Patent [19]

Itoh

[11] 4,146,043

[45] Mar. 27, 1979

[54] DEVICE FOR EXTINGUISHING LIT OBJECTS

[76] Inventor: Isao Itoh, Higashi Tamagawa 1-7-5, Setagaya-ku, Tokyo-to, Japan

[21] Appl. No.: 753,505

[22] Filed: Dec. 22, 1976

[30] Foreign Application Priority Data

Jul. 9, 1976 [JP] Japan ..... 51-80936

[51] Int. Cl.[2] ..... A24F 19/10

[52] U.S. Cl. ..... 131/236

[58] Field of Search ..... 131/236, 237; 118/3; 222/318, 341, 385; 137/512.1; 401/123

[56] References Cited

U.S. PATENT DOCUMENTS

| | | | |
|---|---|---|---|
| 923,201 | 6/1909 | Petigor | 222/341 |
| 1,828,068 | 10/1931 | Pringle | 131/236 |
| 1,866,237 | 7/1932 | Thompson et al. | 222/341 |
| 2,106,046 | 1/1938 | Barlow et al. | 401/148 |

FOREIGN PATENT DOCUMENTS

| | | | |
|---|---|---|---|
| 581039 | 5/1924 | France | 131/236 |

*Primary Examiner*—Robert W. Michell
*Assistant Examiner*—V. Millin
*Attorney, Agent, or Firm*—Cushman, Darby & Cushman

[57] ABSTRACT

A device for extinguishing lit objects comprising a water raising pipe which raises a level of water to a wall where lit objects are extinguished.

2 Claims, 3 Drawing Figures

DEVICE FOR EXTINGUISHING LIT OBJECTS

BACKGROUND OF THE INVENTION (a) Field of the Invention

The present invention relates to a device for extinguishing lit objects, such as smouldering cigarette ends or match sticks, which is simple in its structure and is capable of easily and unfailingly extinguishing such objects.

(b) Description of the Prior Art

Normally, when a cigarette end which is still smouldering is to be discarded, the extinguishment thereof is commonly effected by rubbing the end to an ashtray or by dipping the end in water kept in the ashtray. However, the former is not only troublesome to a person smoking the cigarette but also involves a risk that the cigarette is not completely extinguished so that it may be the cause of a fire especially in the winter season when the air is dry. Further, although the latter can assure complete extinguishment, there is not only an inconvenience that water must always be kept in the ashtray but also a problem that the cleaning of the ashes of discarded cigarette ends caked on the ashtray is difficult.

Therefore, in order to overcome these problems, there have heretofore been proposed some ashtrays wherein a means is provided therein to easily remove that part of a cigarette end which is still smouldering or wherein a wet spongelike object is disposed within the ashtray. However, there were defects in such ashtrays in that they were difficult to clean and their design was unavoidably poor because of their complicated structure.

SUMMARY OF THE INVENTION

The present invention provides a device for extinguishing lit objects, such as smouldering cigarette ends or match sticks, which is free from such defects as were seen in conventional devices, is capable of unfailingly effecting the extinguishment, is easy to manufacture, is adaptable to ready-made ashtrays and is excellent in design.

BRIEF DESCRIPTION OF THE DRAWING

A preferred embodiment of the invention will now be described in detail with reference to the accompanying drawings, in which.

DESCRIPTION OF THE PREFERRED EMBODIMENT

Figure 1:
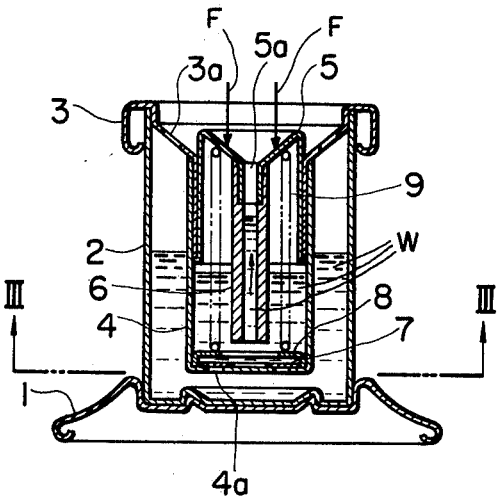
FIG. 1 is a side sectional view of a device for extinguishing lit objects according to the present invention.
Figure 2:
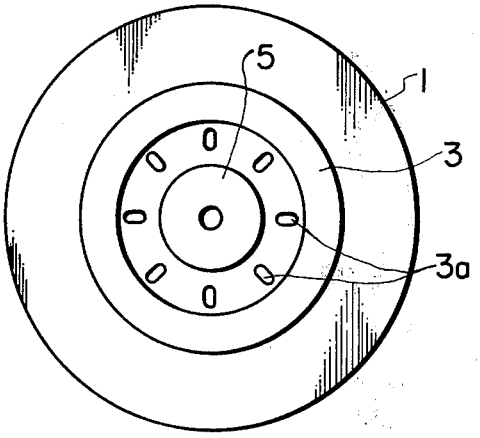
FIG. 2 is a plan view of the device shown in FIG. 1.
Figure 3:
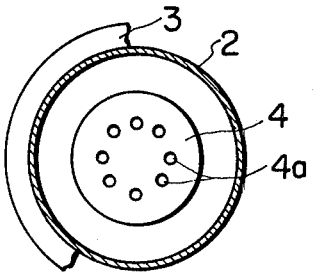
FIG. 3 is a sectional view of the device taken along the line III — III in FIG. 1.

The device as illustrated as a preferred embodiment of the present invention by the accompanying drawings comprises a base 1 which is designed in such a way as to appeal to the visual senses, a water vessel 2 the bottom of which is fixed on the base 1 and the top of which is open, a cap member 3 detachably fixed on the rim of the top opening of the water vessel 2 and provided with a plurality of holes 3*a* on the top wall inclined downwardly to its central opening, a cylindrical member 5 having a funnel shaped top wall having an opening 5*a* and inserted slidably into the central opening of the cap member 3 and having a pipe 6 connected to the central opening and having its lower end in the vicinity of the bottom part of a cup member 4, a valve ring 7 positioned in the cup member 4 so as to be able to float in the cup member 4 and to be able to close holes 4*a* in the bottom of the cup member 4, a valve receiving ring 8 positioned in the cup member 4 with its opened face against the bottom surface of the cup member 4, and a coil spring 9 positioned between the cylindrical member 5 and the valve receiving ring 8 and urging the cylindrical member 5 to project its upper part slightly above the central opening of the cap member 3. The outer diameter of the valve receiving ring 8 is slightly smaller than the inner diameter of the cup member 4 and also the inner diameter of the valve ring 7 is slightly smaller than the valve receiving ring 8, and it is so arranged that the valve receiving ring 8 can restrict the extent of the floatation of the valve ring 7.

The structure of the device for extinguishing lit objects according to the present invention is as described above, so that when the cylindrical member 5 is pressed downwardly as indicated by the arrows F in the state wherein an appropriate amount of water is filled in the water W vessel 2 is such that the levels of the water in the water vessel 2, the cup member 4 and the pipe 6 are positioned about mid way of the height of the water vessel 2, the air enclosed within the cylindrical member 5 above the head of the water therein is compressed and the surface of the water is subjected to downward pressure so that the valve ring 7 is pressed to the bottom surface and the holes 4*a* are closed and, as a result thereof, the level of the water in the pipe 6 is raised to the funnel shaped top surface of the cylindrical member 5. Therefore, for example, when the pressing of the cylindrical member 5 is effected by subjecting the tip of a smouldering cigarette to an appropriate point of the funnel shaped top surface of the cylindrical member 5, the smouldering cigarette is immediately extinguished by the water thus raised thereto. When the pressure to the cylindrical member 5 is released, it returns to the original position mainly by the force of the spring 9 and at the same time the valve ring 7 floats up and the water in the water vessel 2 flows into the cup member 4 through the holes 4*a* therein. Also, the level of the water in the pipe 6 is lowered and the levels of the water in the water vessel 2, the cup member 4 and the pipe 6 again level on the same line and thus one cycle of the extinguishing operations is completed. As is apparent from the foregoing explanation, the speed with which the water level rises in the pipe 6 and the amount of water which is brought up to the funnel shaped top surface of the cylindrical member 5 are determined by the speed of pressing action and the amount of the downward movement of the cylindrical member 5. However, when the cylindrical member 5 is kept pressed, the level of the water in the pipe 6 gradually lowers due to the leakage of water through the holes 4*a* and between the portions of the cylindrical member 5 and the cup member 4 which are in sliding relation and, therefore, water is not excessively supplied to the objects to be extinguished. Further, even if the cylindrical member 5 is pressed too hard causing splashing of water at the funnel shaped top surface, the water thus splashed may be caught by the top wall portion of the cap member 3 and is returned to the water vessel 2 through the holes 3*a* and, therefore, water can be used effectively without waste and it can be assured that the surface of tables will not be made wet by possible splashing of water. Care should be taken that the level of the water in the water vessel 2 is always kept above the lower end of the cylindrical member 5 in its normal position.

According to the above described embodiment of the present invention, the water vessel 2 is fixed to the base 1 so that they are used together as a unit. However, it is to be understood that the water vessel 2 as described above can be utilized by being incorporated into, for example, a conventional ashtray, that is, by placing it on the bottom wall of such a conventional ashtray. Further, in the above described embodiment, the top surface of the cylindrical member 5 is formed in a funnel shape, but this can well be in a form such as a segment of a sphere.

According to the present invention, as explained above, it is possible to easily and unfailingly extinguish lit objects by pressing the cylindrical member only lightly and, therefore, the invention has a great practicable value.

Further, when the device according to the present invention is installed in an ashtray, there is no need to keep water in the ashtray and there is no such trouble as the caking of ashes on the ashtray so that the cleaning thereof is easy. Moreover, the device of the present invention is such that it can be economically manufactured by using press processer in most of the steps involved in the manufacture. The device may also serve to increase an ornamental or design value of the ashtray in which the device is incorporated. Also, the unfailing extinguishment which the device according to the present invention achieves can contribute to the prevention of the occurrence of fires.

While a representative embodiment and details have been shown for purpose of illustrating the invention, it will be apparent to those shilled in this art that various changes and modifications may be made therein without departing from the spirit or scope of the invention.

I claim:

1. A device for extinguishing lit objects, comprising:

peripheral side wall and bottom wall means defining a vessel for containing an extinguishing liquid such as water up to an imaginary intermediate level defined as being both part way up and part way down said peripheral side wall;

peripheral side wall and bottom wall means defining a cup member, said cup member being disposed in said vessel with the bottom wall means of said cup member being disposed below said intermediate level, with spacing laterally between the peripheral side wall of the vessel and the peripheral side wall of the cup member;

a cap, bridging over said spacing; said cap having means defining at least one opening therethrough;

a cylinder member disposed in said cup member, said cylinder member including a peripheral side wall and an upwardly concave, centrally low top wall, the peripheral side wall of said cylinder member being in axially sliding contact with the peripheral side wall of the cup member about their respective perimeters throughout at least part of the height of each of said cylinder member and said cup member; means defining a central opening through said top wall; a water-raising pipe communicated with said opening and extending downwardly therefrom to below said intermediate level;

compression coil spring means received in the cup member and having opposite ends thereof effectively bearing between said cup member bottom wall and said cylinder member top wall for normally urging the cylinder member upwards;

means defining an opening through the cup member, below said intermediate level;

a normally open, extinguishing liquid buoyant valve closure received in said cup for closing and opening said cup member opening;

cage means confining said valve closure below said intermediate level and in the vicinity of said cup member opening, to such a degree of closeness, that, should a user plunge a lighted object such as a cigarette downwards centrally on the top wall of the cylinder member, causing the cylinder member to be displaced downwards against restoring force provided by said compression coil spring means, at a time when extinguishing liquid is contained in said vessel up to said intermediate level, and that liquid consequently rises in said pipe sufficiently to issue upwards through said cylinder member top wall opening, said valve closure will be forced closed, temporarily, correspondingly temporarily substantially blocking liquid communication between the cup member, internally thereof, and said vessel member, internally thereof, below said intermediate level.

2. The device of claim 1, wherein:

the opening through said cup is disposed in the bottom wall thereof;

said valve closure confining member is constituted by an inverted, dished, annular valve receiving ring disposed on the bottom wall of said cup, said valve receiving ring caging said valve closure between said valve receiving ring and said cup bottom wall; and said valve receiving ring being interposed between the bottom wall of said cup and the lower end of said coil spring, so that said coil spring bears against said cup bottom wall via said valve receiving ring;

said cap being supported on said vessel peripheral wall, and said cup member depending from said cap into said vessel;

further comprising a base supporting said vessel;

each of said cap opening and said bottom wall opening being constituted by a plurality of holes arranged in a ring;

said valve closure also being ring-shaped.

* * * * *